US006257315B1

(12) United States Patent
Spink

(10) Patent No.: US 6,257,315 B1
(45) **Date of Patent: *Jul. 10, 2001**

(54) CASTING STEEL STRIP

(75) Inventor: John Anthony Spink, Shellharbour (AU)

(73) Assignees: Ishikawajima-Harima Heavy Industries Company Ltd., Tokyo (JP); BHP Steel (JLA) Pty Ltd., New South Wales (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/332,994

(22) Filed: Jun. 15, 1999

Related U.S. Application Data

(63) Continuation-in-part of application No. 08/958,908, filed on Oct. 28, 1997, now Pat. No. 5,924,476.

(51) Int. Cl.[7] ..... B22D 11/06

(52) U.S. Cl. ..... 164/480; 164/428

(58) Field of Search ..... 164/428, 480

(56) References Cited

U.S. PATENT DOCUMENTS 5,924,476 * 7/1999 Spink ..... 164/480

* cited by examiner

*Primary Examiner*—Kuang Y. Lin
(74) *Attorney, Agent, or Firm*—Miles & Stockbridge P.C.; John C. Kerins

(57) ABSTRACT

Continuous casting of steel strip in twin-roll caster comprising casting rolls (16). Molten steel is delivered by a delivery system comprising a distributor (18) and delivery nozzle (19) to casting pool (68) supported above the nip (69) between the casting rolls (16) which are rotated to deliver a solidified steel strip (20) downwardly from the nip. The casting pool is confined by side closures (56) comprising refractory plates to contact and dam the molten steel. To minimise reactions between carbon in the pool closures with oxygen containing compounds in the casting pool the side closure plates are made of refractory material containing a major proportion of a refractory aggregate and a minor proportion of graphite of at least 96% purity in the range of 10 to 30% by weight and an anti-oxidant additive being aluminium or an alloy thereof. The refractory aggregate may be comprised mainly of alumina.

28 Claims, 11 Drawing Sheets

CASTING STEEL STRIP

CROSS REFERENCE TO RELATED APPLICATION

This application is a continuation-in-part of application Ser. No. 08/958,908, filed Oct. 28, 1997, now U.S. Pat. No. 5,924,476.

TECHNICAL FIELD

This invention relates to the casting of steel strip.

It is known to cast metal strip by continuous casting in a twin roll caster. In this technique molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side closures, for example side plates or dams held in sliding engagement with surfaces of the rolls so as to dam the two ends of the casting pool against outflow, although alternative means such as electromagnetic barriers have also been proposed.

Although twin roll casting has been applied with some success to non-ferrous metals which solidify rapidly on cooling, there have been problems in applying the technique to the casting of ferrous metals. One particular problem encountered in the casting of aluminium killed steel in a twin roll strip caster is the propensity for molten steel to produce solid inclusions, in particular inclusions which contain aluminates. Such inclusions can affect the surface quality of the strip as well as having the tendency to block any small casting passages in the metal delivery system. This has led to the use of manganese/silicon killed steels as an alternative, such as described in our New Zealand Patent Application 270147. However, such silicon/manganese killed steels have inherently a significantly higher oxygen content than aluminium killed steels and this, along with the ability of oxides present in the molten steel to be reduced, gives rise to problems in casters in which the casting pool is in contact with refractory materials which contain carbon. This may arise where the delivery nozzle formed of a carbon containing refractory material dips into the casting pool and where the pool confining side closures are formed wholly or in part of such a refractory material, for example alumina graphite. The exposure of the casting pool to carbon containing refractories causes the pool to be disturbed by carbon monoxide bubbles generated by reactions between carbon in the submerged delivery nozzle and oxygen containing compounds in the molten metal of the casting pool. More particularly, ferrous oxide or other oxides in the slag present in the casting pool react with carbon to be reduced to iron or other metals respectively. The pool disturbance caused by the carbon monoxide bubbles from such reduction leads to the formation of discrete waves in the casting pool which are reflected in the cast strip as depressions in the strip surface. These defects are commonly referred to as meniscus marks. Moreover, carbon leaching from the refractory material exposed to the casting pool is enhanced.

It should be noted that in casting aluminium killed steels the aluminates present in the molten metal are not readily reduced and in fact carbon cannot reduce same under such casting conditions.

Our International Patent Application PCT/AU96/00244 describes a proposal to address this problem by the controlled addition of sulphur to the silicon/manganese killed steel melt at least in the start-up phase of a casting operation. However, the controlled addition of sulphur to the steel adds complexity to the process and results in the production of steel with high sulphur content which may not generally be acceptable to all markets. By the present invention the problem is addressed by modifying the chemical composition of the refractory material exposed to the casting pool rather than that of the steel melt.

Our U.S. patent application Ser. No. 958908 describes how the refractory material of the metal delivery nozzle may be selected to minimise reaction with the oxygen containing compounds in the casting pool. The same refractory material may also be used in the construction of the pool confining side closures. For example, the side closures may be comprised of components made of alumina graphite in which the graphite has a purity of at least 96%. Simple alumina graphite side closures have suffered from poor abrasion resistance and excessive wear. This problem is avoided by the use of boron nitride closures which have superior abrasion resistance and which also do not react chemically with the oxygen containing compounds in the pool. However, baron nitride closures are very expensive to produce.

Recent developments in the design of the pool confining side closures have addressed the abrasion resistance and wear problems to permit the use of refractories such as alumina graphite. In particular, there have been proposals for multi-part or composite pool confining side closures with wear faces or pads applied to backing plates and with lubricant applicators to apply lubricant to the wear faces during operation of the caster. One such proposal is described in International Patent Publication WO 98/35775 of Nippon Steel Corporation. The present invention is particularly applicable to strip casters with composite side closures of this general kind although it could also be applied to side closures in the form of simple refractory plates.

DISCLOSURE OF THE INVENTION

According to the invention there is provided method of continuously casting steel strip of the kind in which molten steel is introduced into the nip between a pair of parallel casting rolls to create a casting pool of molten steel supported on casting surfaces of the rolls immediately above the nip and the casting rolls are rotated to deliver a solidified steel strip downwardly from the nip, wherein the ends of the pool are confined by side closures comprised of bodies of refractory material in contact with the molten steel of the pool, said refractory material comprising a major proportion of a refractory aggregate and a minor proportion of graphite in the range of 10 to 30% by weight and an anti-oxidant additive being aluminium or an alloy thereof, and wherein the graphite has a purity of at least 96%.

The invention also provides apparatus for casting steel strip, comprising a pair of parallel casting rolls forming a nip between them, an elongate delivery nozzle disposed above and extending along the nip between the casting rolls for delivery of molten steel into the nip to form a casting pool of molten steel supported on casting surfaces of the rolls above the nip, side closures to confine the two ends of the pool and means to rotate the rolls to produce a solidified steel strip passing downwardly from the nip, wherein the side closures are comprised of bodies of refractory material to contact the molten steel of the pool which refractory material comprises a major proportion of a refractory aggregate and a minor proportion of graphite in the range of 10 to 30% by weight and an anti-oxidant additive being aluminium or an alloy thereof, and wherein the graphite has a purity of at least 96%.

Preferably the purity of the graphite is of the order of 98% or higher.

Preferably the anti-oxidant additive contains the metal aluminium.

Preferably further the amount of the anti-oxidant additive in the refractory material is around 2% by weight.

It is preferred that the proportion of graphite be of the order of 20 to 24%.

The refractory aggregate may comprise any one or more of the compounds alumina, magnesia, zirconia and spinel. However, it is preferable that the aggregate be comprised mainly of alumina.

Preferably, any additives are such that the refractory material is essentially free of sodium.

The refractory aggregate will generally be selected on the basis of thermal shock resistance, corrosion resistance and cost. Carbon components are generally added to refractory materials to provide good thermal shock resistance, machining capability and corrosion resistance. If carbon is used in the refractory material for this purpose it then becomes desirable to provide additives to protect the carbon from oxidation and to increase the strength of the refractory material. Common additives include borax, boron carbide, silicon, aluminium and magnesium aluminium alloy.

As a result of experimental work to be described below we have determined that in order to avoid the carbon leaching and gas generation problem in refractories exposed to the casting pool it is critically important that the carbon component be in the form of graphite of very high purity. The quantity of graphite is also important although not as critical as the purity of the graphite. However, an important factor influencing the quantity of graphite is the need to have a sufficient amount of graphite in the refractory material to avoid the material cracking from thermal shock upon contact with the molten metal.

The experimental work has shown that the presence of sodium in the refractory material will be detrimental and cause increased gas generation. Accordingly, the refractory material should preferably not contain soda additions and any anti-oxidant additions should preferably not contain sodium. It has been shown that the anti-oxidants containing aluminium cause the least generation of gas and such anti-oxidants are preferred.

BRIEF DESCRIPTION OF THE DRAWINGS

In order that the invention may be more fully explained our experimental work and one particular method and apparatus in accordance with the invention will be described with reference to the accompanying drawings in which.

DETAILED DESCRIPTION OF THE PREFERRED EMBODIMENT

Figure 1:
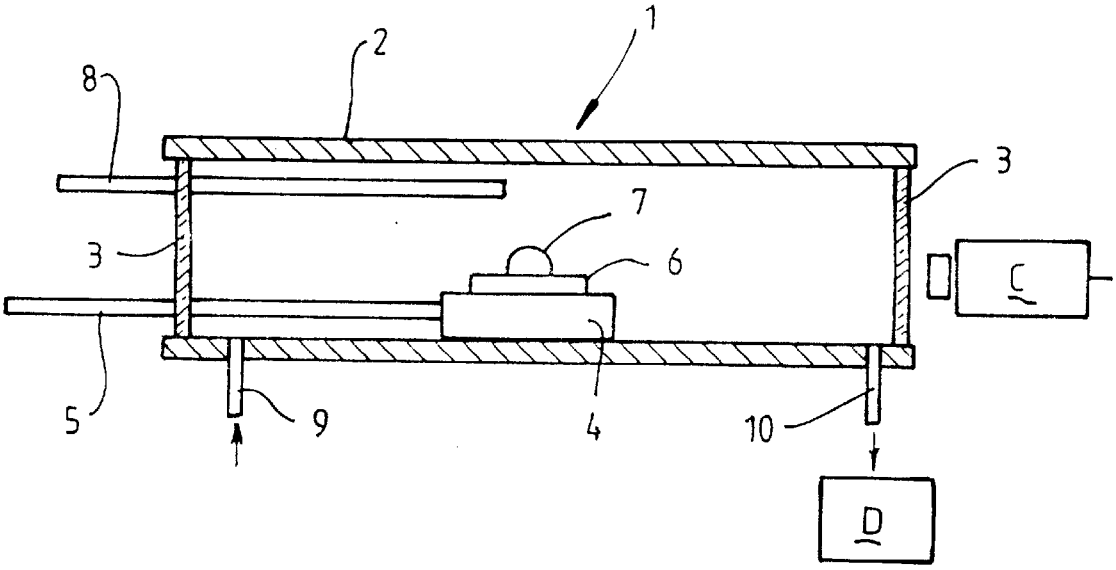
FIG. 1 diagrammatically illustrates an experimental apparatus for testing the reaction between a slag sample and a refractory substrate under conditions simulating those occurring in the casting pool of a strip caster.

FIG. 1 illustrates an experimental set-up for examining the reaction between a slag sample and a refractory substrate under conditions simulating those which apply in the casting pool of a twin roll caster. The apparatus comprising a test chamber 1 formed by arc alumina tube 2 closed at its ends by quartz windows 3.

Chamber 1 contains a graphite tray 4 which can be positioned by means of a graphite rod 5 extending out of the chamber. A sample refractory substrate 6 is placed on the tray 5 and supports a drop of a slag sample 7. The apparatus is located in an electric furnace to enable the refractory substrate and slag sample to be heated to temperatures of the order of 1600° C. to simulate the conditions occurring in the casting pool of a twin roll caster. The temperature is measured by a thermocouple 8 and the chamber is provided with a gas inlet 9 and gas outlet 10 to provide a flow of an inert gas and to enable the quantity of carbon monoxide generated by reaction between the slag sample 7 and the refractory substrate 6 to be measured by a detector D at the gas outlet. The physical condition of the slag sample 7 can be viewed by a CCD camera C which views the sample through one of the quartz windows 3.

FIGS. 2 to 11 show the results of tests in which samples of a typical slag generated by a silicon manganese killed steel were placed on three substrates of graphite of differing purities and ten substrates of differing refractory materials as summarised in Table 1.

TABLE 1

| COMPONENT | SAMPLES FOR COMPONENT TESTING 1 | 2 | 3 | 4 | 5 | 6 | 7 | 8 | 9 | 10 | 11 | 12 | 13 |
|---|---|---|---|---|---|---|---|---|---|---|---|---|---|
| 94% purity graphite | 100 | | | | | | | | | | | | |
| 98% purity graphite | | 100 | | | | | | | | | | | |
| 99% purity graphite | | | 100 | 30 | 30 | 30 | 30 | 30 | 20 | 10 | 30 | 30 | 30 |
| alumina | | | | Y | Y | Y | Y | Y | Y | Y | Y | Y | |
| spinel | | | | | | | | | | | | | Y |
| sodium addition | | | | | | 0.3 | 0.8 | | | | | | |
| silicon | | | | | | | | Y | Y | Y | | | |
| aluminum | | | | | | | | | | | Y | | |
| boron carbide | | | | | | | | | | | | Y | |
| resin binder | | | | | Y | Y | Y | Y | Y | Y | Y | Y | Y |

The slag used in the experiments comprised MnO and $SiO_2$ in the ratio 60:40.

Figure 2:
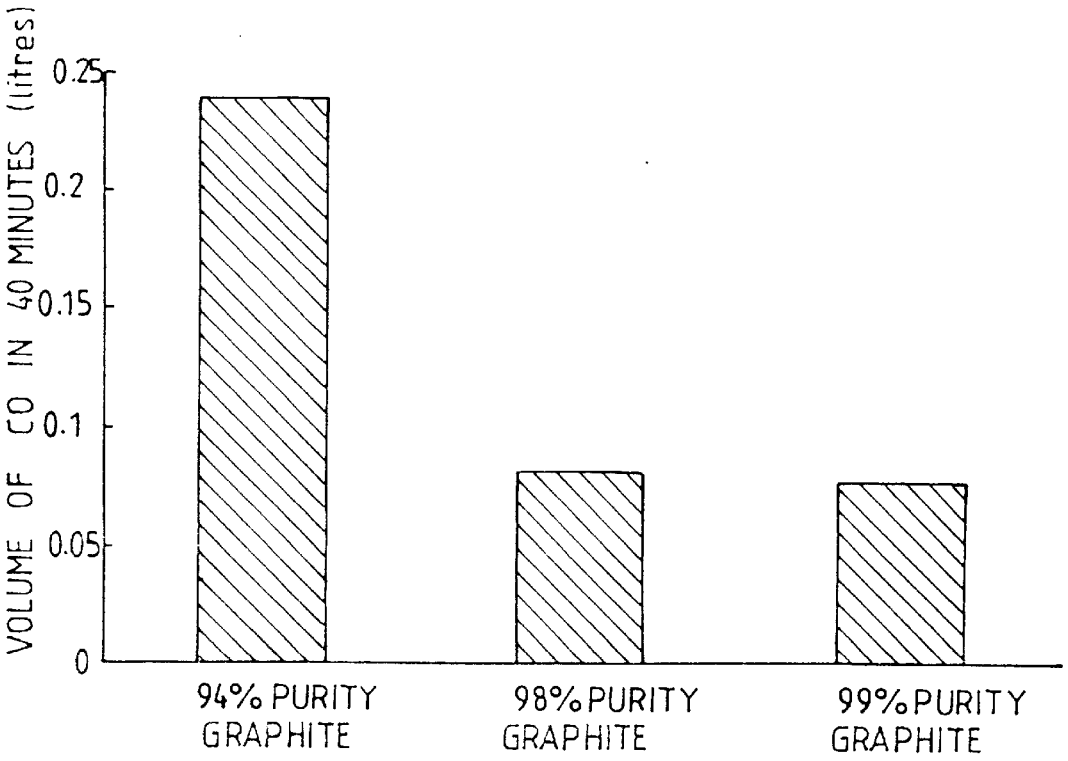
FIGS. 2 and 3 display the results of measurements of the volume of carbon monoxide generated during two particular tests using refractories with graphite of differing purities.
Figure 3:
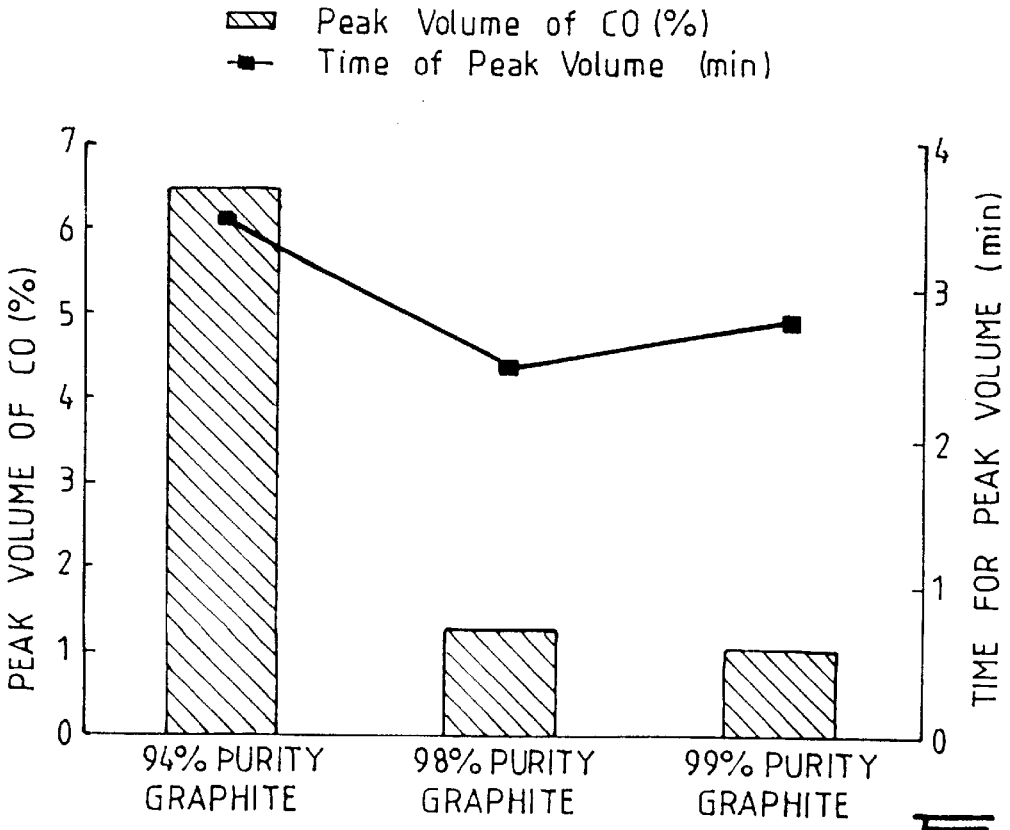

FIGS. 2 and 3 illustrate the results of tests carried out using graphite substrates of 94% purity, 98% purity and 99% purity set out as samples 1 to 3 in the above table. Specifically, FIG. 2 plots total volume of carbon monoxide produced in 40 minute tests whereas FIG. 3 plots both the peak volume of carbon monoxide and the time of the peak volume. These tests were conducted to determine the effect of graphite purity on the reaction between graphite and a typical slag generated by a silicon manganese killed steel. It will be seen that there is a dramatic reduction in the generation of carbon monoxide if the purity of the graphite is increased from 94% to 98% purity, whereas the further increase in purity to 99% has little effect on the generation of carbon monoxide. During these tests it was observed that the droplet of slag material did not slump on the high purity substrates to the same degree as the slag on the 94% purity graphite. It is accordingly believed that the increased gas generation with the low purity graphite is due to the presence of gangue or ash impurities which are relatively porous and cause enhanced wetting of the substrate compared with the high purity graphite substrates which produced very high wetting angles through the period of the tests.

Figure 4:
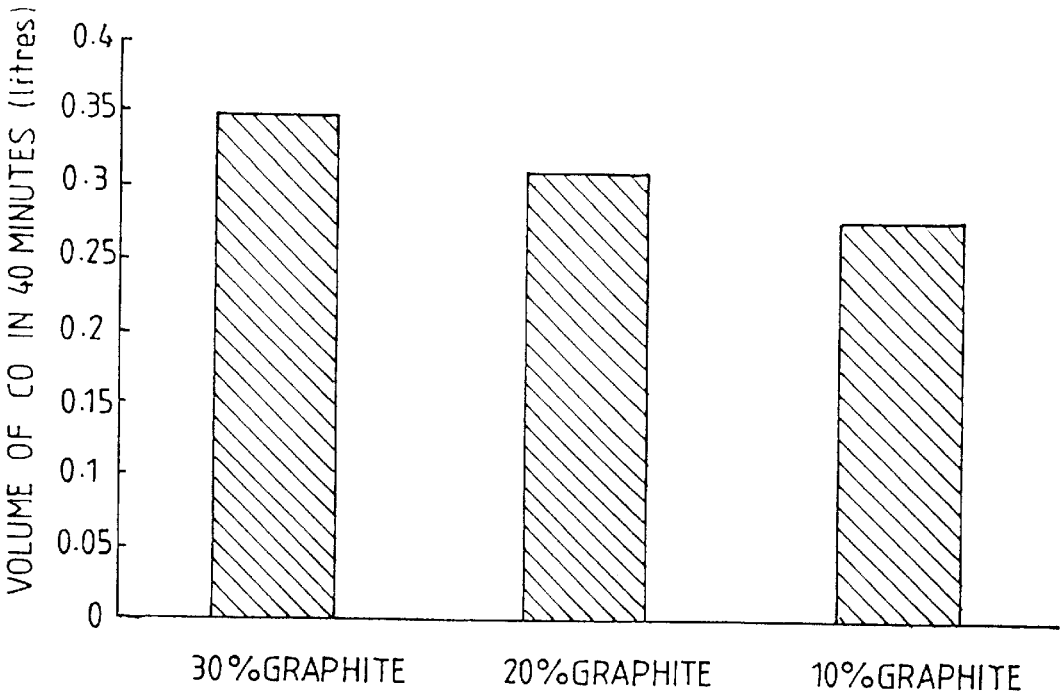
FIGS. 4 and 5 show experimental results demonstrating the effect of graphite content.
Figure 5:
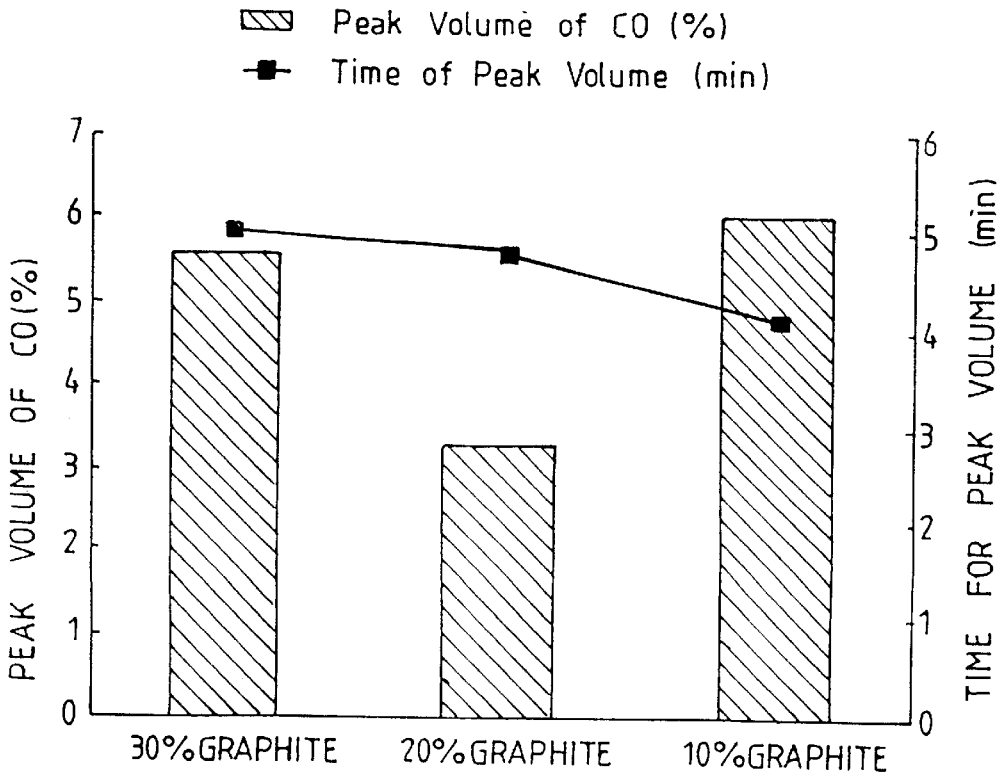

FIG. 4 illustrates the results of measurements of the total volume of carbon monoxide produced in 40 minute tests on the specific refractory substrate samples 8, 9 and 10 and FIG. 5 plots the peak volume of carbon monoxide measured during these tests. The refractory samples 8, 9 and 10 each comprised graphite of 99% purity but in the proportions 30%, 20% and 10% respectively. These tests were carried out to determine the effect of the amount of graphite in the refractory material. The tests show that the effect of varying the quantity of graphite in the refractory material is not as dramatic as the effect of the graphite purity but there are indications that the peak volume of carbon monoxide gas production is minimised if the proportion of graphite is around 20%. It is thought that this may be due to a balance between wetting and quantity effects. There is also a balance between thermal shock resistance, wetting effects and corrosion resistance. Thermal shock resistance and corrosion resistance are both reduced with decreasing carbon content. On the other hand, decreasing carbon content will lead to increased wetting of the substrate. Balancing these effects suggests an optimum graphite content in the range 20% to 24%.

Figure 6:
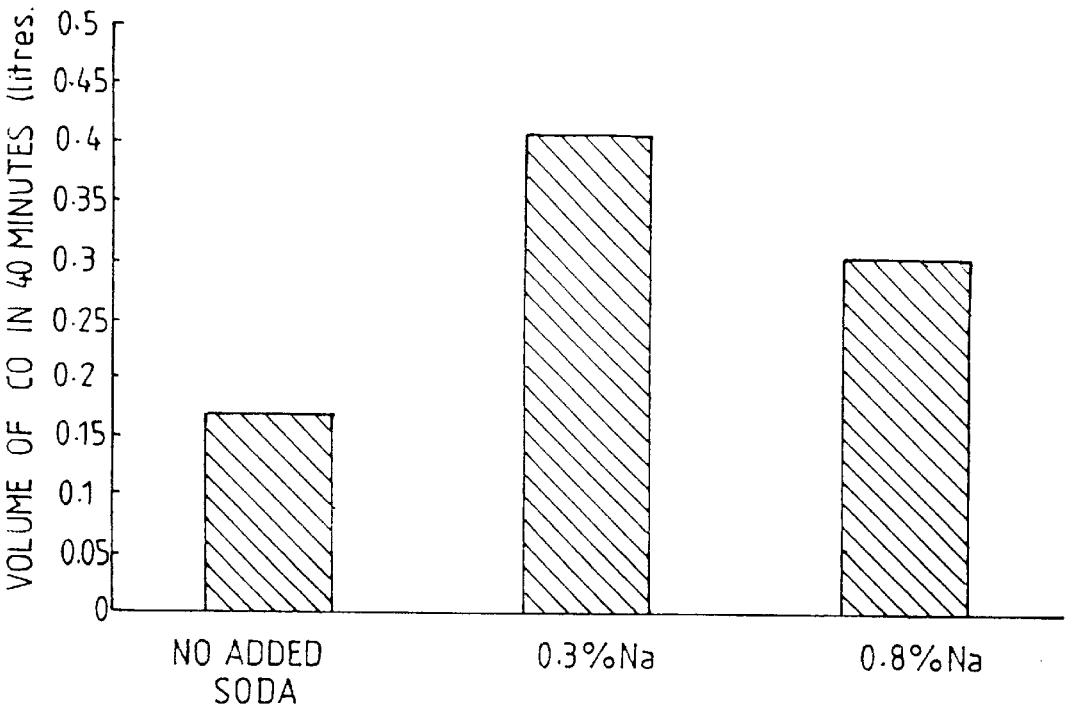
FIGS. 6 and 7 show experimental results demonstrating the effect of sodium addition.
Figure 7:
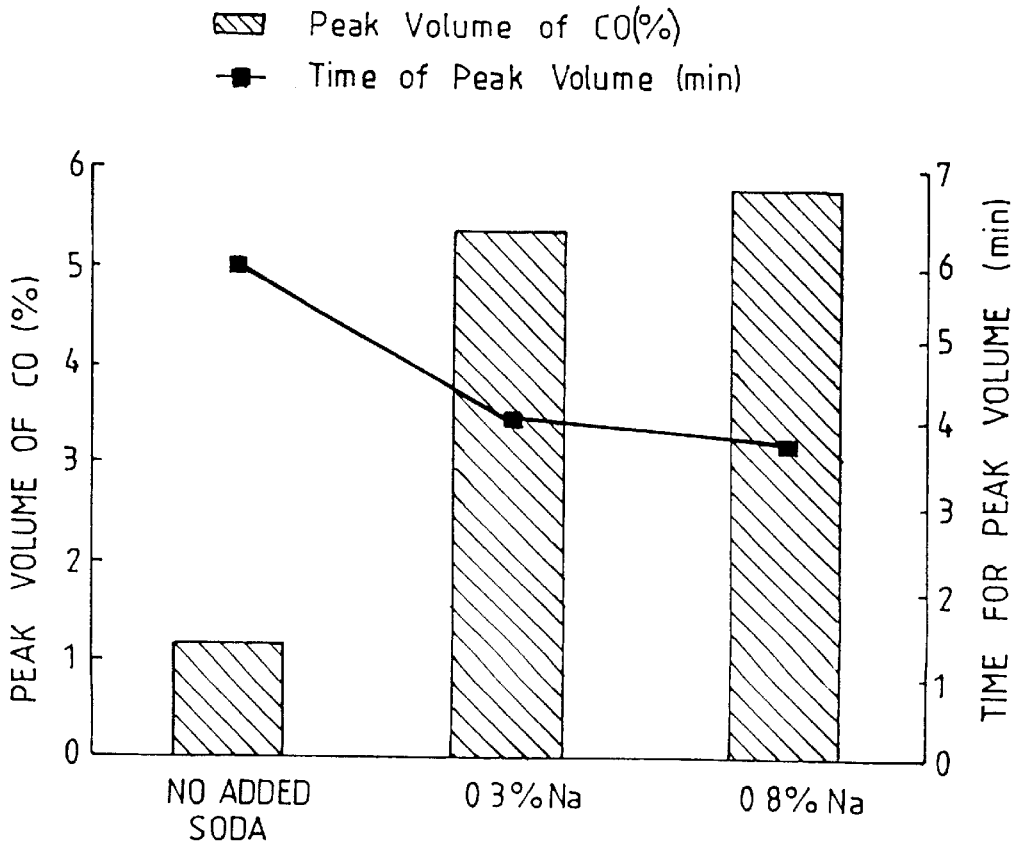

FIGS. 6 and 7 show the results of tests on substrate samples 5, 6 and 7 and were conducted to indicate the effect of the sodium content of anti-oxidant additives. FIG. 6 plots the total volume of carbon monoxide produced during the 40 minute test periods whereas FIG. 7 plots both the peak volume of carbon monoxide and the time of the peak volume in minutes. The results indicate that sodium addition has a very detrimental effect in increasing carbon monoxide gas generation. It is thought that this effect may be due to the action of sodium compounds as good wetting agents. The sodium additions were in the form of sodium silicate. It can be concluded that the refractory material should not contain sodium based anti-oxidant additives.

Figure 8:
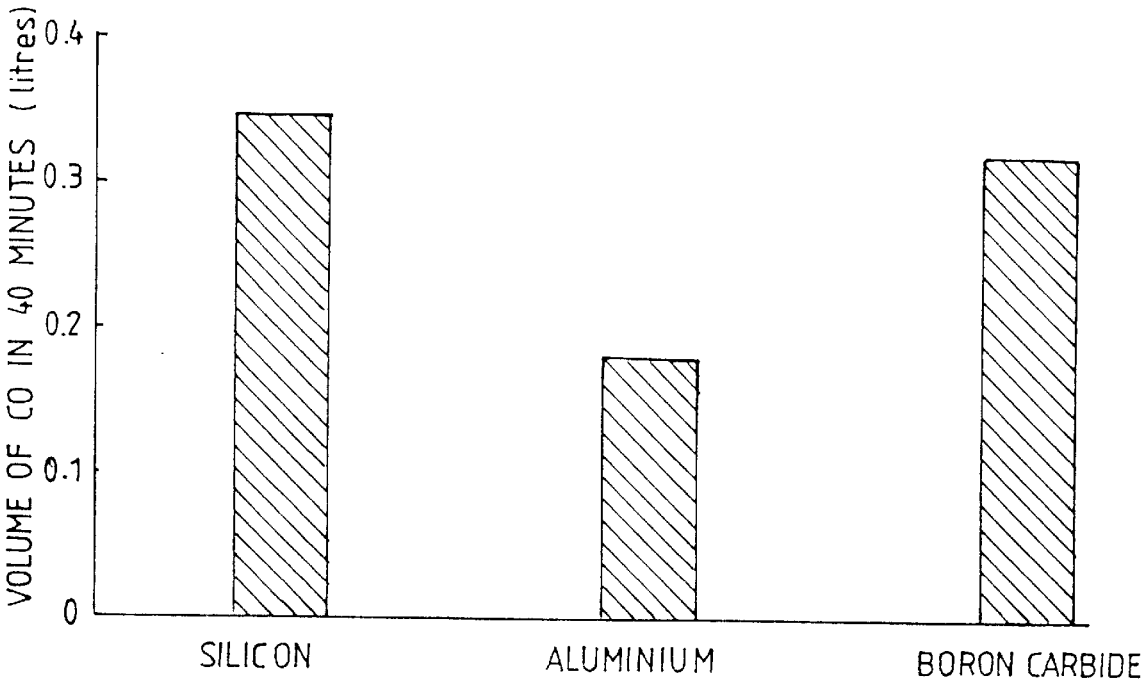
FIGS. 8 and 9 show experimental results demonstrating the effect of anti-oxidant type.
Figure 9:
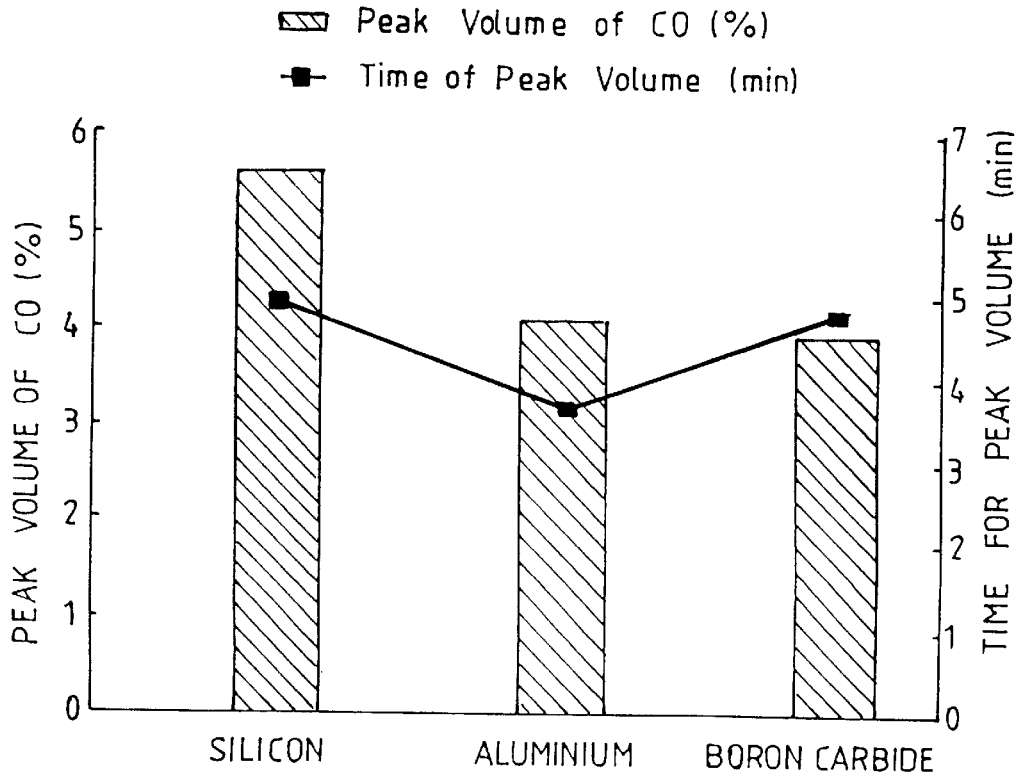

FIGS. 8 and 9 give the results of tests on samples 8, 11 and 12. These samples all had the same graphite level but used different anti-oxidant additives. The tests show that aluminium based anti-oxidant additives will result in less carbon monoxide generation than additives containing silicon or boron carbide. Observation of the slag sample during these tests showed that the slag droplet slumped on the substrates containing silicon and boron carbide whereas the slag droplet on the substrate containing the aluminium additive actually contracted to demonstrate a less wetting condition as the substrate was heated and it stayed in this condition throughout the test. This indicates that the aluminium additive suppresses wetting of the slag on the refractory material to help minimise generation of carbon monoxide gas.

Figure 10:
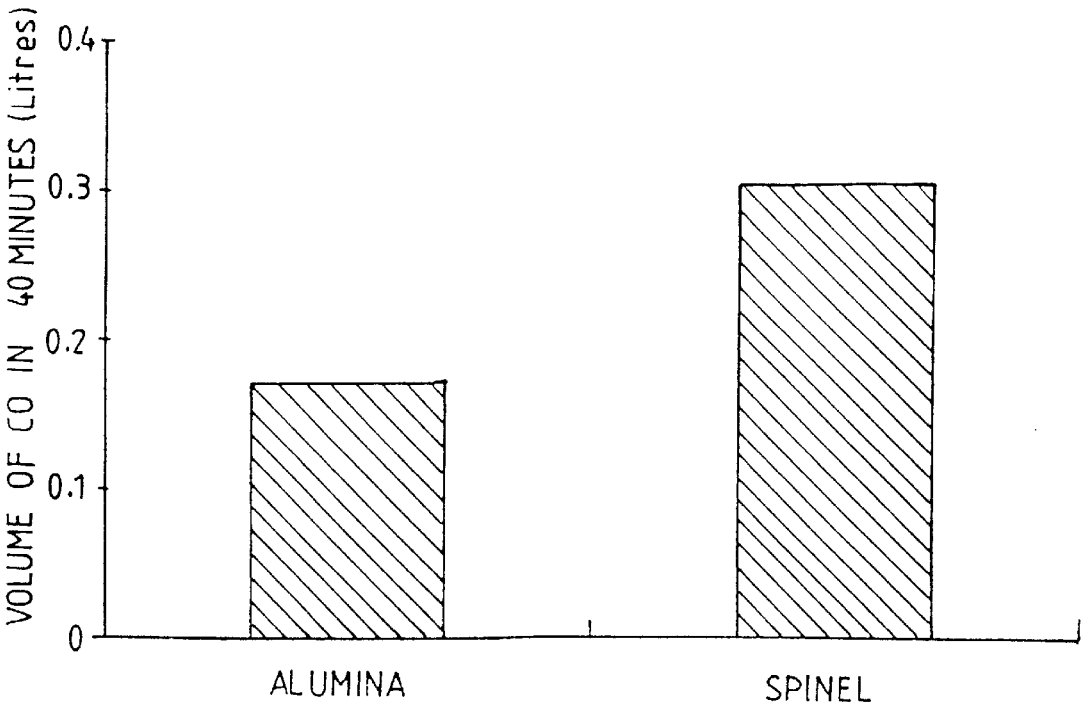
FIGS. 10 and 11 show experimental results demonstrating the effect of aggregate type.
Figure 11:
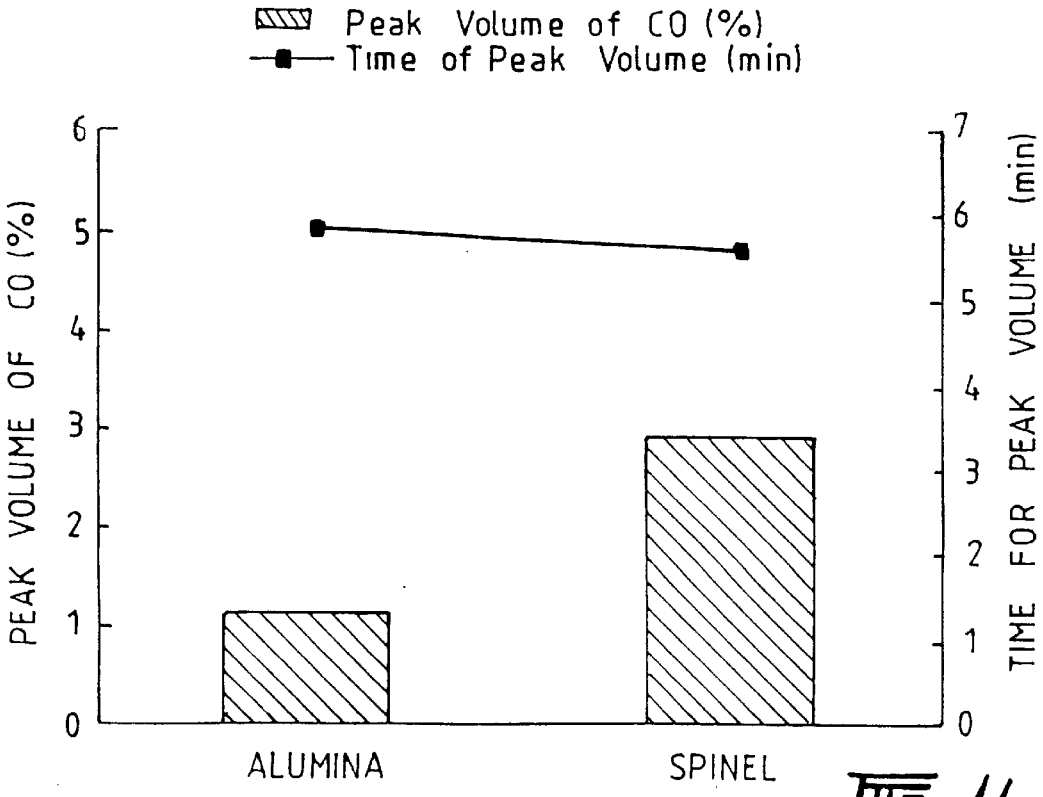
Figure 12:
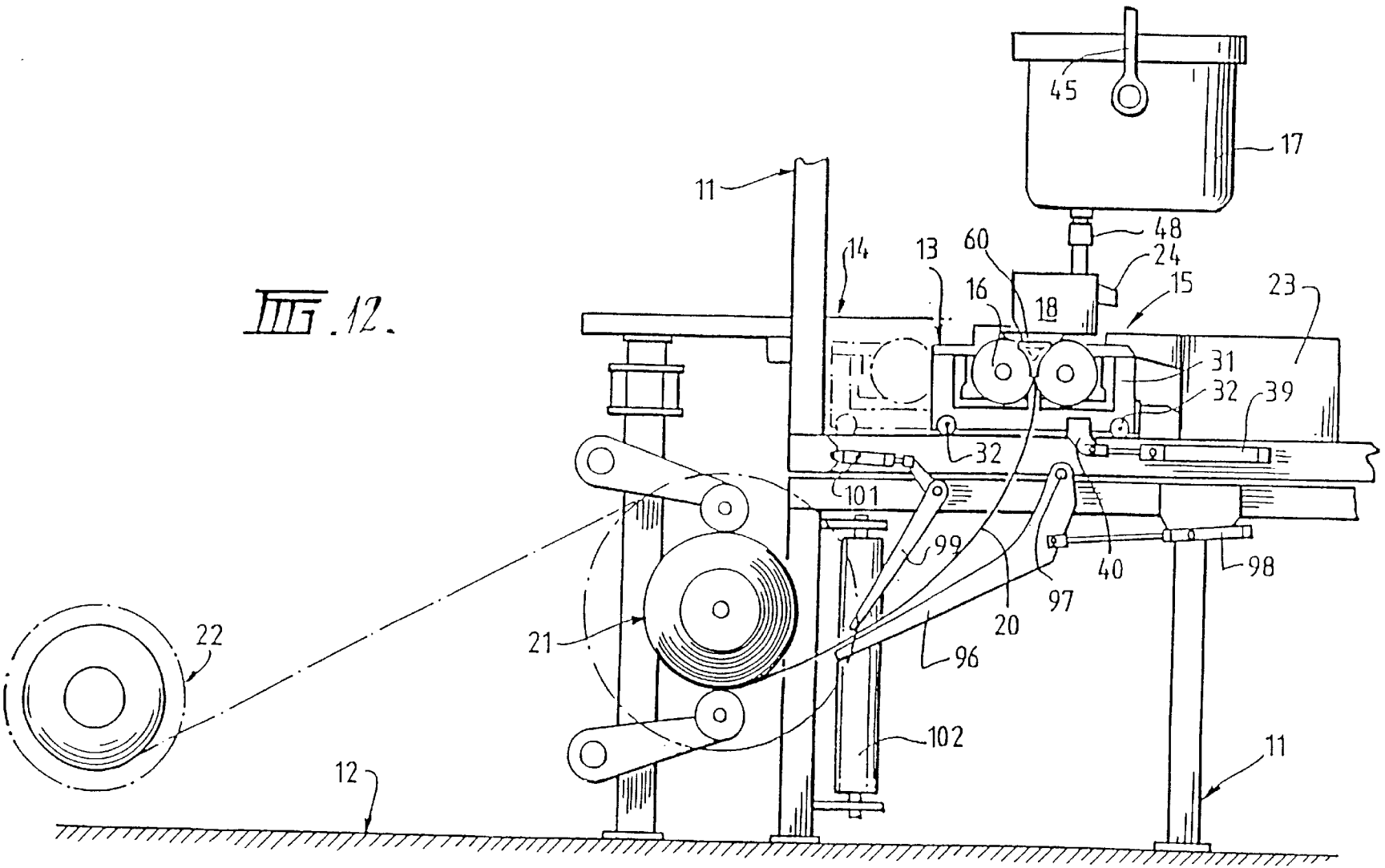
FIG. 12 illustrates a twin roll continuous strip caster constructed and operating in accordance with the present invention.
Figure 13:
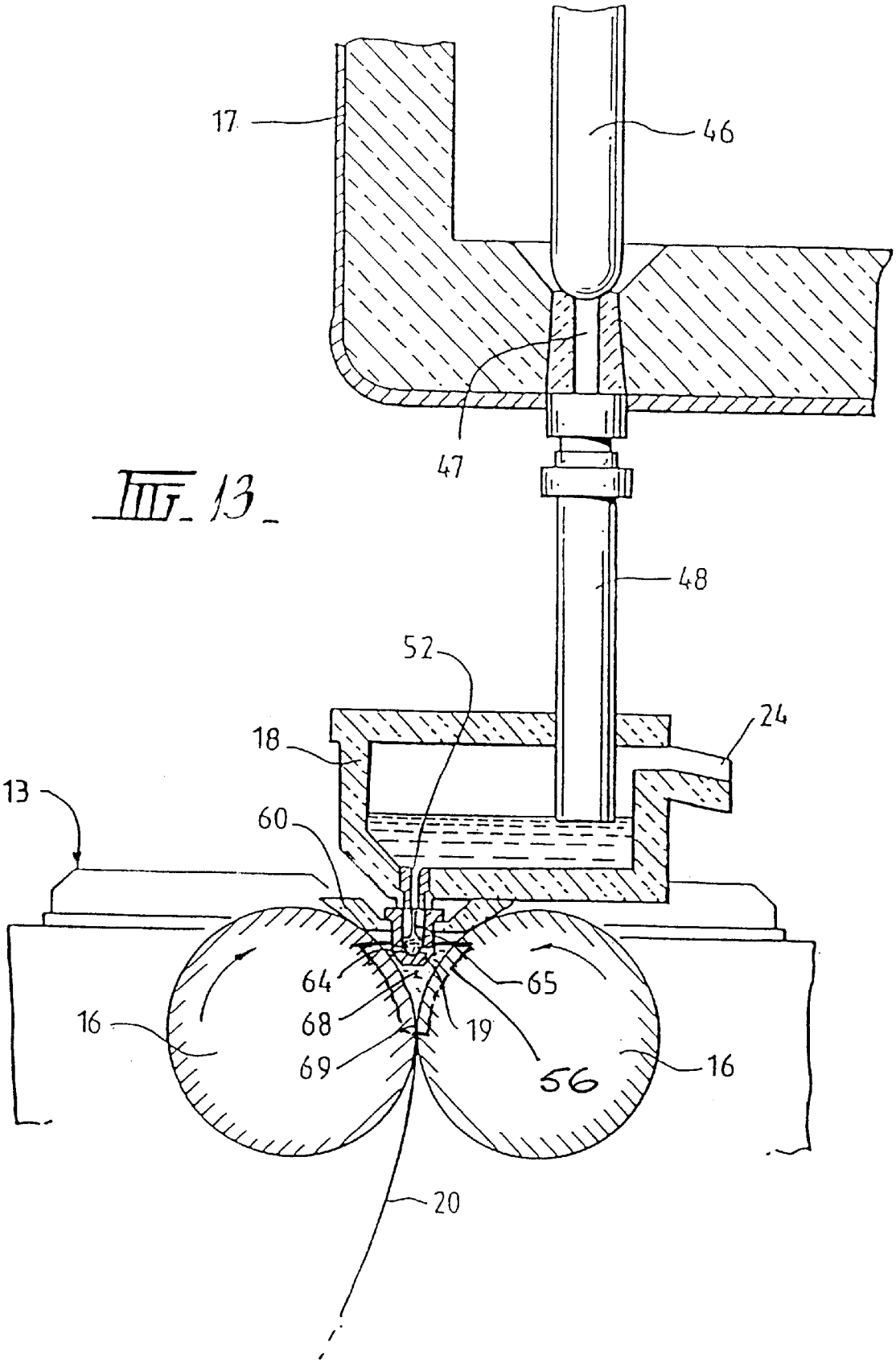
FIG. 13 is a vertical cross-section through important components of the caster illustrated in FIG. 12 including a metal delivery nozzle constructed in accordance with the invention.
Figure 14:
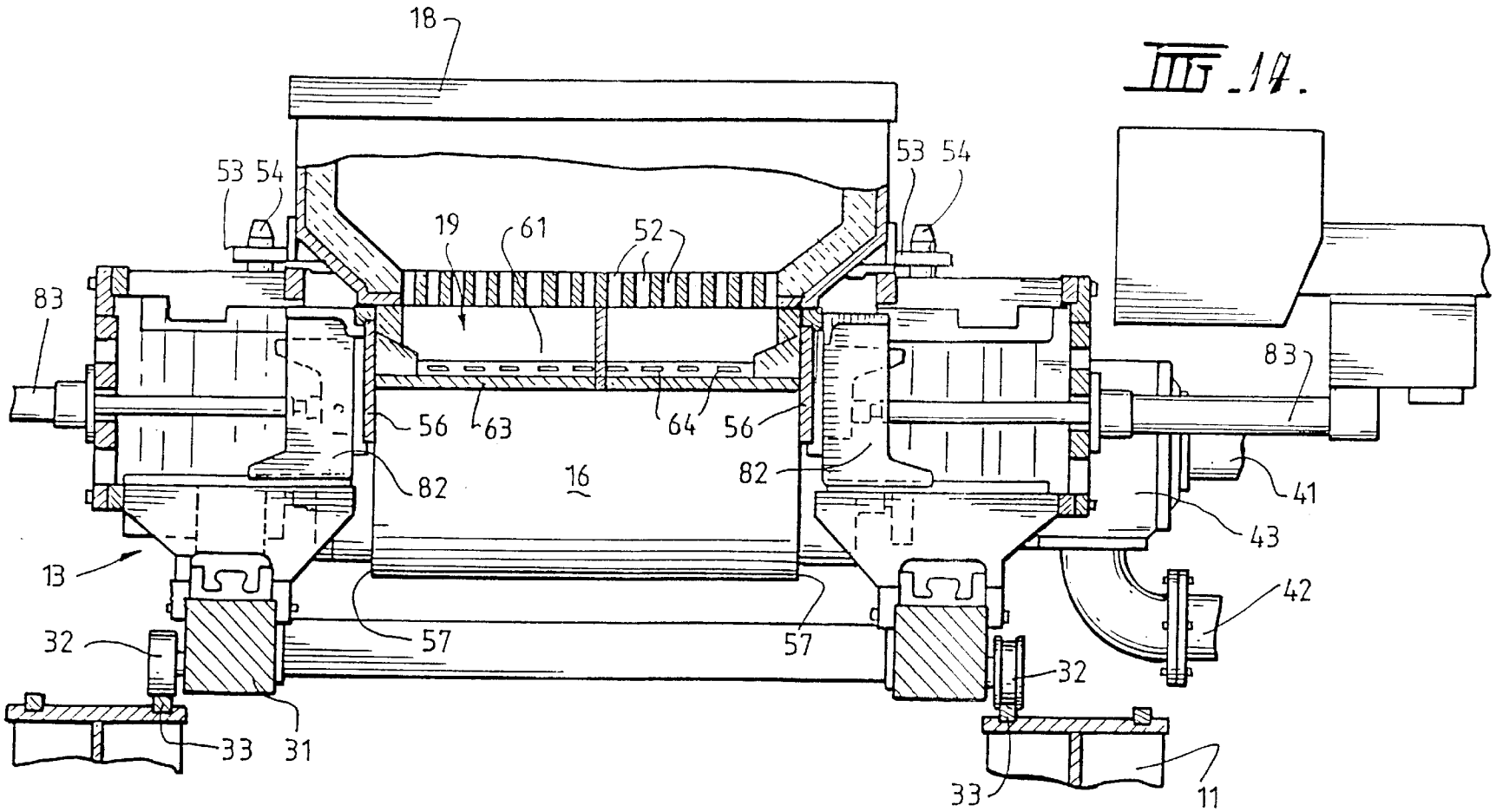
FIG. 14 is a further vertical cross-section through important components of the caster taken transverse to the section of FIG. 13.

FIGS. 10 and 11 give the results of tests using the refractory substrate samples 12 and 13 to compare the effect of using spinel as an aggregate instead of alumina. These tests indicate that the use of alumina as the basic refractory aggregate material results in low carbon monoxide gas generation and that aggregates containing aluminium may be preferred to other aggregates.

The results of the testing program indicate that the amount of carbon monoxide generation can be reduced by using a refractory material which includes high purity graphite (preferably of the order of 98% purity), a low proportion of graphite (preferably in the range 20% to 24%) and by selecting additives and aggregates that reduce carbon monoxide generation from reaction with the slag, particularly additives and aggregates containing aluminium.

Table 2 gives the results of further testing of selected refractory compositions under like conditions to the other samples tested with the volume of carbon monoxide generated after 40 minutes by reaction with a typical slag sample being recorded.

TABLE 2

FURTHER REFRACTORY MATERIALS TESTED

| COMPONENTS* | A | B | C | D |
|---|---|---|---|---|
| Graphite Purity (%) | 94 | 94 | 98 | 98 |
| Graphite Content (%) | 22 | 15 | 15 | 15 |
| Additives | silicon and "soda" flux | silicon and boron carbide | aluminium-silicon alloy | silicon and boron carbide |
| Volume of CO after 40 min. (L) | 0.60 | 0.39 | 0.13 | 0.53 |

Other than refractory aggregates being mainly alumina.

It can be seen from Table 2 that sample C, which is a combination of all the chosen materials and which is according to the invention, displays an unusually good result of 0.13 litres of carbon monoxide. Sample D establishes that the replacement of anti-oxidant additive being a metal alloy according to the invention, with another known anti-oxidant such as silicon and boron carbide, is detrimental to gas generation.

In order to avoid refractory cracking dur to thermal shock it is necessary that the refractory material have a graphite content of at least 10%, and preferably at least 15%. To avoid burnout on exposure to the casting pool the refractory should contain no more than 30% graphite, and preferably no more than 25%.

FIGS. 12 to 16 illustrates a twin roll continuous strip caster constructed and operated in accordance with the present invention. This caster comprises a main machine frame 11 which stands up from the factory floor 12. Frame 11 supports a casting roll carriage 13 which is horizontally moveable between an assembly station 14 and a casting station 15. Carriage 13 carries a pair of parallel casting rolls 16 to which molten metal is supplied during a casting operation from a ladle 17 via a distributor 18 and delivery nozzle 19. Casting rolls 16 are water cooled so that shells solidify on the moving roll surfaces and are brought together at the nip between them to produce a solidified strip product 20 at the nip outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the distributor.

Roll carriage 13 comprises a carriage frame 31 mounted by wheels 32 on rails 33 extending along part of the main machine frame 11 whereby roll carriage 13 as a whole is mounted for movement along the rails 33. Carriage 13 is moveable along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra-rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The rolls may typically be about 500 mm diameter and up to 2 m long in order to produce up to 2 m wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into distributor 18.

Distributor 18 is formed as a wide dish made of a refractory material such as high alumina castable with a sacrificial lining. One side of the distributor receives molten metal from the ladle and is provided with the aforesaid overflow 24. The other side of the distributor is provided with a series of longitudinally spaced metal outlet openings 52. The lower part of the distributor carries mounting brackets 53 for mounting the distributor onto the roll carriage frame 31 and provided with apertures to receive indexing pegs 54 on the carriage frame so as accurately to locate the distributor.

Figure 15:
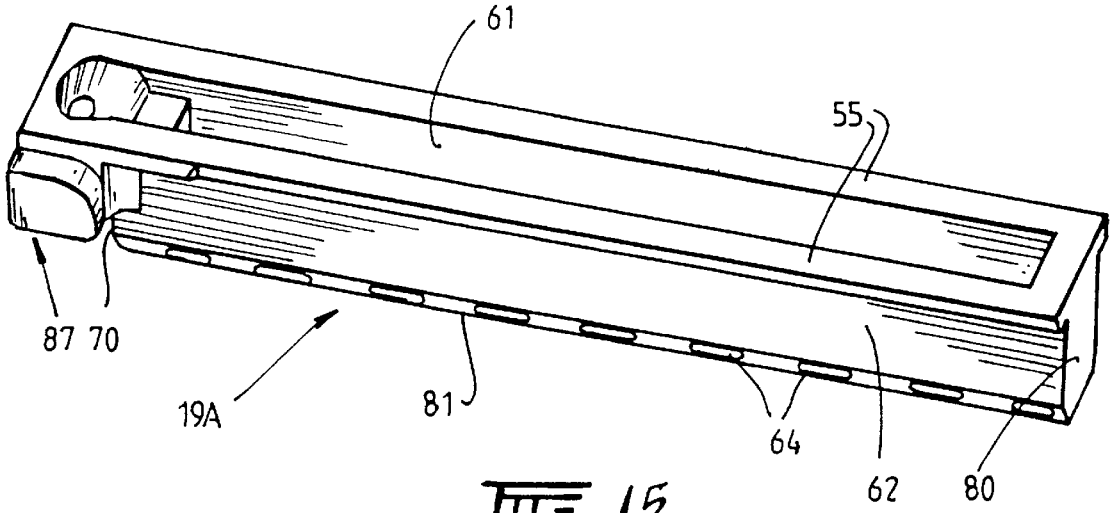
FIG. 15 is a perspective view of the delivery nozzle segment.
Figure 16:
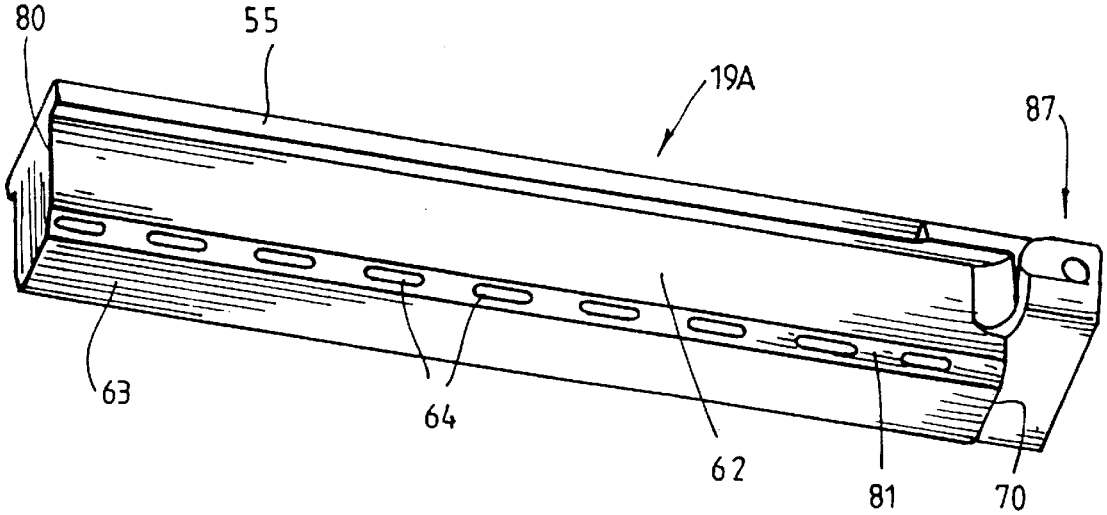
FIG. 16 is an inverted perspective view of the nozzle segment.

Delivery nozzle 19 is formed in two identical half segments which are made of alumina graphite refractory material and are held end to end to form the complete nozzle. FIGS. 15 and 16 illustrate the construction of the nozzle segments 19A which are supported on the roll carriage frame by a mounting bracket 60, the upper parts of the nozzle segments being formed with outwardly projecting side flanges 55 which locate on that mounting bracket.

Each nozzle half segment is of generally trough formation so that the nozzle 19 defines an upwardly opening inlet trough 61 to receive molten metal flowing downwardly from the openings 52 of the distributor. Trough 61 is formed between nozzle side walls 62 and end walls 70 and may be considered to be transversely partitioned between its ends by the two flat end walls 80 of the nozzle segments which are brought together in the completed nozzle. The bottom of the trough is closed by a horizontal bottom floor 63 which meets the trough side walls 62 at chamfered bottom corners 81. The nozzle is provided at these bottom corners with a series of side openings in the form of longitudinally spaced elongate slots 64 arranged at regular longitudinal spacing along the nozzle. Slots 64 are positioned to provide for egress of molten metal from the trough generally at the level of the trough floor 63.

The outer ends of the nozzle segments are provided with end formations denoted generally as 87 extending outwardly beyond the nozzle end wall 70 and provided with metal flow passages to direct separate flows of molten metal to the "triple point" regions of the pool ie those regions of the pool where the two rolls and the side dam plates come together. The purpose of directing hot metal to those regions is to prevent the formation of "skulls" due to premature solidification of metal in these regions.

Molten metal falls from the outlet openings 52 of the distributor in a series of free-falling vertical streams 65 into the bottom part of the nozzle trough 61. Molten metal flows from this reservoir out through the side openings 64 to Lorm a casting pool 68 supported above the nip 69 between the casting rolls 16. The casting pool is confined at the ends of rolls 16 by a pair of side closure plates 56 which are held against the ends 57 of the rolls. Side closure plates 56 are mounted in plate holders 82 which are moveable by actuation of a pair of hydraulic cylinder units 83 to bring the side plates into engagement with the ends of the casting rolls to form end closures for the casting pool of molten metal.

During a casting operation the ladle stopper rod 46 is actuated to allow molten metal to pour from the ladle to the distributor through the metal delivery nozzle whence it flows to the casting rolls. The clean head end of the strip product 20 is guided by actuation of an apron table 96 to the jaws of the coiler 21. Apron table 96 hangs from pivot mountings 97 on the main frame and can be swung toward the coiler by actuation of an hydraulic cylinder unit 98 after the clean head end has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

In the casting operation the flow of metal is controlled to maintain the casting pool at a level such that the lower end of the delivery nozzle 19 is submerged in the casting pool and the two series of horizontally spaced side openings 64 of the delivery nozzle are disposed immediately beneath the surface of the casting pool. The molten metal flows through the openings 64 in two laterally outwardly directed jet streams in the general vicinity of the casting pool surface so as to impinge on the cooling surfaces of the rolls in the immediate vicinity of the pool surface. This maximises the temperature of the molten metal delivered to the meniscus regions of the pool and it has been found that this significantly reduces the formation of cracks and meniscus marks on the melting strip surface.

The illustrated apparatus can be operated to establish a casting pool which rises to a level above the bottom of the delivery nozzle so that the casting pool surface is above the floor of the nozzle trough and at about the same level as the metal within the trough. Under these conditions it is possible to obtain stable pool conditions and if the outlet slots are angled downwardly to a sufficient degree it is possible to obtain a quiescent pool surface.

In accordance with the present invention the side closure plates 56 are made of alumina graphite in which the graphite has a purity of at least 96%. Typically the alumina graphite material of the plates 56 may comprise of the order of 75% to 78% $Al_2O_3$, and 20% to 24% of 98% purity graphite. It also contains a metal alloy containing aluminium as an anti-oxidant and binder. The use of this modified refractory material containing high purity graphite and the inclusion of aluminium or aluminium alloy anti-oxidant additive in accordance with the present invention inhibits the generation of carbon monoxide bubbles in the casting pool due to reaction with the oxygen containing compounds in the molten steel, even when casting silicon/manganese killed steels with high oxygen contents.

Figure 17:
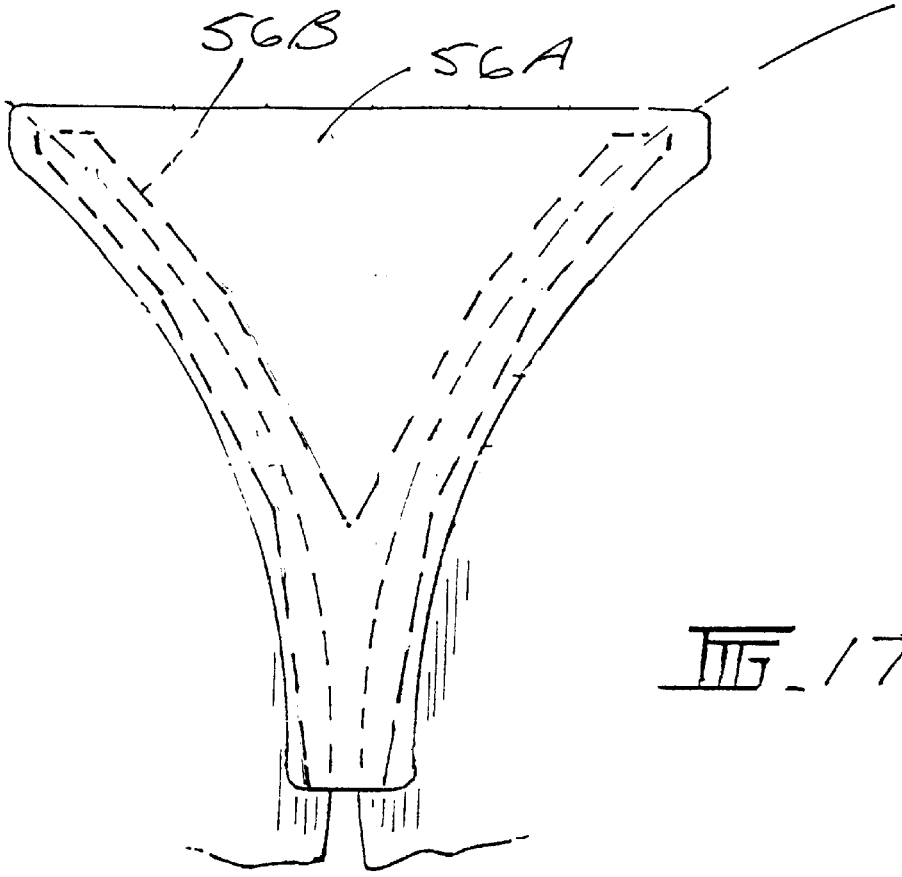
FIGS. 17 and 18 illustrate a modified form of pool side closure.
Figure 18:
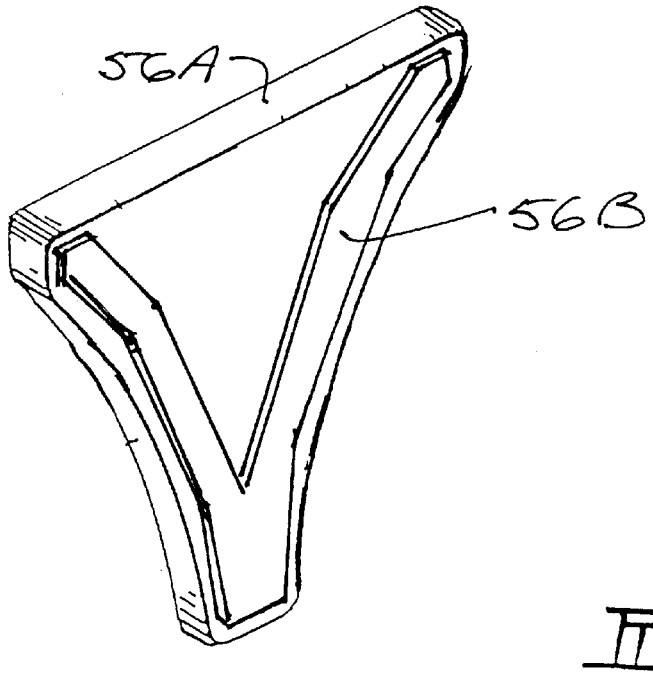

The alumina graphite side closure plates 56 generally have poor abrasion resistance and will wear rapidly, so requiring frequent replacement. In circumstances where such rapid wear cannot be tolerated, the simple side closure plates may be replaced by closures as illustrated in FIGS. 17 and 18. These closures comprise backing plates 56A to which ceramic wear pads 56B are bonded to provide wear surfaces which engage the ends of the casting rolls. The interengaging roll and side dam wear surfaces may be lubricated by the application of solid lubricant to the roll ends at positions adjacent the side closures or by pushing lubricant through passages formed in the side dam closures in the manner which is disclosed in International Patent Publication WO 98/35775 of Nippon Steel Corporation. In accordance with the present invention, the backing plates 56A which engage the molten metal of the casting pool between the wear pads and provide the main damming function are formed of alumina graphite refractory material in which the graphite has a purity of at least 96%.

What is claimed is:

1. A method of continuously casting steel strip comprising:

introducing molten steel between a pair of chilled casting rolls to form a casting pool of molten steel supported above the nip, confining the pool by side closures comprised of bodies of refractory material in contact with the molten metal of the pool; and rotating the rolls so as to cast the solidified strip delivered downwardly from the nip;

wherein said refractory material comprises a major proportion of a refractory aggregate and a minor proportion of graphite in the range of 10 to 30% by weight and an anti-oxidant additive being aluminium or an alloy thereof and wherein the graphite has a purity of at least 96%.

2. A method as claimed in claim 1, wherein the purity of the graphite is of the order of 98% or higher.

3. A method as claimed in claim 1, wherein the proportion of graphite is in the range of about 20% to about 24% by weight.

4. A method as claimed in claim 2, wherein the proportion of graphite is in the range of about 20% to about 24% by weight.

5. A method as claimed in claim 1, wherein the amount of the anti-oxidant additive is about 2% by weight.

6. A method as claimed in claim 1, wherein the refractory aggregate comprises any one or more of the compounds alumina, magnesia, zirconia and spinel.

7. A method as claimed in claim 1, wherein the refractory aggregate is comprised mainly of alumina.

8. A method as claimed in claim 1, wherein the refractory material of the nozzle is essentially free of sodium.

9. A method as claimed in claim 1, wherein the bodies of refractory material are in the form of a pair of plates which serve to dam the molten metal at each end of the casting pool.

10. A method as claimed in claim 9, wherein the plates directly engage the ends of the casting rolls.

11. A method as claimed in claim 9, wherein the plates carry raised wear pads to engage the ends of the casting rolls.

12. Apparatus for casting steel strip, comprising a pair of parallel casting rolls forming a nip between them, an elongate delivery nozzle disposed above and extending along the nip between the casting rolls for delivery of molten steel into the nip to form a casting pool of molten steel supported on casting surfaces of the rolls above the nip, side closures to confine the two ends of the pool, and means to rotate the rolls to produce a solidified strip passing downwardly from the nip, wherein the side closures are comprised of bodies of refractory material to contact the molten steel of the pool, said refractory material comprising a major proportion of a refractory aggregate and a minor proportion of graphite in the range of 10 to 30% by weight and an anti-oxidant additive being aluminium or an alloy thereof and wherein the graphite has a purity of at least 96%.

13. Apparatus as claimed in claim 12, wherein the purity of the graphite is of the order of 98% or higher.

14. Apparatus as claimed in claim 12, the proportion of graphite is in the range of about 20% to about 24% by weight.

15. Apparatus as claimed in claim 13, the proportion of graphite is in the range of about 20% to about 24% by weight.

16. Apparatus as claimed in claim 12, wherein the amount of the anti-oxidant additive is about 2% by weight.

17. Apparatus as claimed in claim 12, wherein the anti-oxidant is aluminium-silicon alloy.

18. Apparatus as claimed in claim 12, wherein the refractory aggregate comprises any one or more of the compounds alumina, magnesia, zirconia and spinel.

19. Apparatus as claimed in claim 12, wherein the refractory aggregate is comprised mainly of alumina.

20. Apparatus as claimed in claim 12, wherein the bodies of refractory material are in the form of plates extending transversely across adjacent ends of the casting rolls.

21. Apparatus as claimed in claim 20, wherein the plates directly engage the ends of the casting rolls.

22. Apparatus as claimed in claim 20, wherein the plates carry raised wear pads to engage the ends of the casting rolls.

23. A pool confinement side closure for confining a molten steel casting pool in a twin roll caster, comprising a body of a refractory material to contact the molten steel of the casting pool, said refractory material comprising a major proportion of a refractory aggregate and a minor proportion of graphite in the range of 10 to 30% by weight and an anti-oxidant additive being aluminium or an alloy thereof and wherein the graphite has a purity of at least 96%.

24. A pool confinement side closure as claimed in claim 23, wherein the purity of the graphite is of the order of 98% or higher.

25. A pool confinement side closure as claimed in claim 23, wherein the proportion of graphite is in the range of about 20% to about 24% by weight.

26. A pool confinement side closure as claimed in claim 23, wherein the amount of the anti-oxidant additive is about 2% by weight.

27. A pool confinement side closure as claimed in claim 23, wherein the anti-oxidant is aluminium-silicon alloy.

28. A pool confinement side closure as claimed in claim 23, wherein the refractory aggregate comprises any one or more of the compounds alumina, magnesia, zirconia and spinel.

* * * * *